US010285433B2

(12) United States Patent
Ademe

(10) Patent No.: US 10,285,433 B2
(45) Date of Patent: May 14, 2019

(54) CAPSULE OBJECT RUPTURE TESTING SYSTEM AND ASSOCIATED METHOD

(71) Applicant: R.J. Reynolds Tobacco Company, Winston-Salem, NC (US)

(72) Inventor: Balager Ademe, Winston-Salem, NC (US)

(73) Assignee: R.J. Reynolds Tobacco Company, Winston-Salem, NC (US)

( * ) Notice: Subject to any disclaimer, the term of this patent is extended or adjusted under 35 U.S.C. 154(b) by 372 days.

(21) Appl. No.: 15/003,197

(22) Filed: Jan. 21, 2016

(65) Prior Publication Data

US 2017/0208856 A1 Jul. 27, 2017

(51) Int. Cl.
*A24C 5/343* (2006.01)
*A24D 3/06* (2006.01)
*A24D 3/04* (2006.01)

(52) U.S. Cl.
CPC ..... *A24C 5/343* (2013.01); *A24D 3/061* (2013.01); *A24D 3/048* (2013.01)

(58) Field of Classification Search
CPC ..... A24C 5/343; A24D 3/061
See application file for complete search history.

(56) References Cited

U.S. PATENT DOCUMENTS 4,884,696 A * 12/1989 Peleg ..... B07C 5/00 198/408
8,186,359 B2 5/2012 Ademe et al.
8,905,243 B2 12/2014 Dixon et al.
9,766,114 B2 * 9/2017 Ademe ..... G01G 19/00
(Continued)

FOREIGN PATENT DOCUMENTS

GB 2178293 A * 2/1987 ..... A24C 5/34
JP WO 2013187245 A1 * 12/2013 ..... A24D 1/02
WO 2013187245 A1 12/2013

OTHER PUBLICATIONS

International Search Report dated Apr. 11, 2017 for International Application No. PCT/IB2017/050315.
http://www.sotax.com/products/physical-testing/hardness/.

*Primary Examiner* — Nathaniel T Woodward
(74) *Attorney, Agent, or Firm* — Womble Bond Dickinson (US) LLP

(57) ABSTRACT

A capsule rupture testing system includes a positioning channel configured to receive one or more smoking article filters therein. The smoking article filters include a filter material and a capsule object disposed therein. The system includes a smoking article positioning device configured to position the smoking article filter elements at a testing position within the positioning channel. The system includes a rupturing device that includes an actuating element configured to operably engage at least one smoking article filter element at the testing position. The testing position aligns the actuating element with an expected position of the capsule object. The rupturing device also includes a measuring element configured to determine a deformation measurement associated with deforming the filter element. The system also includes an analysis unit configured to analyze the deformation measurement and configured to determine a rupture point of the capsule object. An associated method is also provided.

18 Claims, 11 Drawing Sheets

(56) References Cited

U.S. PATENT DOCUMENTS

| | | | | |
|---|---|---|---|---|
| 2009/0194118 | A1* | 8/2009 | Ademe | A24C 5/3412<br>131/346 |
| 2014/0131579 | A1* | 5/2014 | Ademe | G01N 21/95<br>250/341.1 |
| 2016/0128378 | A1* | 5/2016 | Kuersteiner | A24D 3/04<br>131/331 |

* cited by examiner

CAPSULE OBJECT RUPTURE TESTING SYSTEM AND ASSOCIATED METHOD

FIELD OF THE DISCLOSURE

The present disclosure relates to capsule objects and more particularly to a capsule object rupture testing system and related methods. The capsule objects may be included in smoking articles, and may be made or derived from tobacco, or otherwise incorporate tobacco. The capsule objects may be intended for human consumption.

BACKGROUND OF THE DISCLOSURE

Popular tobacco products, such as cigarettes, smokeless tobacco products, and/or the like typically include a tobacco or tobacco-related material such as shredded tobacco (e.g., in cut filler form). Some tobacco products further include a capsule object within the tobacco and/or tobacco-related product. For example, a smokeless tobacco product configured for insertion into the mouth of a user may include a pouch portion that contains a tobacco formulation having a tobacco material and a plurality of microcapsules therein, as disclosed in U.S. Pat. No. 8,695,609 to Dube et al., which is incorporated herein by reference in its entirety. In another example, a cigarette may include a tobacco rod and a filter element that incorporates a capsule therein, as disclosed in U.S. Pat. No. 7,984,719 to Dube et al., which is incorporated herein by reference in its entirety.

Various types of capsules suitable for use in tobacco products, tobacco product components that incorporate breakable capsules, and equipment and techniques associated with manufacturing those tobacco product components, are proposed in U.S. Pat. No. 6,631,722 to MacAdam et al.; U.S. Pat. No. 7,479,098 to Thomas et al.; U.S. Pat. No. 7,833,146 to Deal; U.S. Pat. No. 7,972,254 to Stokes et al.; U.S. Pat. No. 8,186,359 to Ademe et al.; U.S. Pat. No. 8,262,550 to Barnes et al.; U.S. Pat. No. 8,303,474 to Iliev et al.; U.S. Pat. No. 8,308,623 to Nelson et al.; U.S. Pat. No. 8,353,810 to Garthaffner et al.; U.S. Pat. No. 8,381,947 to Garthaffner et al.; U.S. Pat. No. 8,459,272 to Karles et al.; U.S. Pat. No. 8,739,802 to Fagg; U.S. Pat. No. 8,905,243 to Dixon et al. and U.S. Pat. No. 9,055,768 to Henley et al.; U.S. Pat. App. Pub. Nos. 2010/0184576 to Prestia et al.; 2011/0271968 to Carpenter et al.; to Henley et al. and 2013/0085052 to Novak III, et al.; and U.S. patent application Ser. No. 14/835,962, to Ademe, filed Aug. 26, 2015; which are incorporated herein by reference. Additionally, representative cigarette products that possess filter elements incorporating breakable capsules have been marketed throughout the world under the brandnames such as "Marlboro W-Burst 5," "Kent iSwitch," "Kool Boost," "Camel Lights with Menthol Boost," "Camel Crush," "Camel Silver Menthol," "Camel Filters Menthol," and "Camel Crush Bold." Furthermore, representative types of vapor delivery systems that incorporate breakable capsules have been proposed in U.S. Pat. Pub. Nos. 2014/0261486 to Potter; 2015/0059780 to Davis; 2015/0335070 to Sears et al.; which are incorporated herein by reference.

Exemplary types of capsules, capsule ingredients, capsule configurations and formats, capsule sizes, capsule properties and capsule preparation techniques are set forth in U.S. Pat. No. 5,223,185 to Takei et al.; U.S. Pat. No. 5,387,093 to Takei; U.S. Pat. No. 5,882,680 to Suzuki et al.; U.S. Pat. No. 6,719,933 to Nakamura et al.; U.S. Pat. No. 7,754,239 to Mane; U.S. Pat. No. 6,949,256 to Fonkwe et al.; U.S. Pat. No. 7,984,719 to Dube et al.; U.S. Pat. No. 8,470,215 to Zhang and U.S. Pat. No. 8,695,609 to Dube; U.S. Pat. App. Pub. Nos. 2004/0224020 to Schoenhard; 2005/0196437 to Bednarz et al.; 2005/0249676 to Scott et al. and 2014/0053855 to Hartmann et al.; and PCT WO 03/009711 to Kim and PCT WO 2014/170947 to Iwatani; which are incorporated herein by reference. Additionally, examples of representative types of capsules and capsule components have been commercially available as "Momints" by Yosha! Enterprises, Inc. and "Ice Breakers Liquid Ice" from The Hershey Company; and representative types of capsules and capsule components have been incorporated into chewing gum, such as the type of gum marketed under the tradename "Cinnaburst" by Cadbury Adams USA.

During the production of these tobacco products, inspection of the capsule and/or the tobacco product may occur. Example systems for analyzing, inspecting, and/or sorting defective tobacco products and/or capsules included therein are set forth in U.S. Pat. No. 8,905,243 to Dixon; U.S. Pat. App. Pub. No. 2014/0131579 to Ademe et al.; and U.S. patent application Ser. No. 14/835,962 to Ademe et al., filed Aug. 26, 2015, which are incorporated herein by reference in their entirety. For example, inspection of the capsules to be included in the tobacco products may occur before, during, and/or after the production of the tobacco product. Inspection of the capsules during and/or after the production of the tobacco product that includes the capsule may provide additional difficulties. For example, a system configured to inspect capsules after the tobacco product has been produced could allow for the introduction of a defective capsule in the final tobacco product, thereby wasting materials by producing a defective tobacco product. In this regard, the manufactured tobacco product that includes the defective capsule cannot be sold for consumption because the perception of the quality of the product may be damaged.

As such, it may be desirable to inspect capsules to determine which capsules are defective before incorporating any capsules into a tobacco product. In particular, it may be desirable to determine if a capsule, which includes an outer shell and an inner payload, has dimensions, attributes, and/or properties that are substantially equal to or within predetermined acceptable interval limits. Further, it may be desirable to perform the inspection of capsules largely, or entirely, by high-speed automated machinery. As such, there exists a need for a system and method for inspecting capsules for defects prior to the capsules being included within a tobacco product for distribution and sale. It may also be desirable for such a solution to be readily implemented with respect to existing tobacco product production machinery.

SUMMARY OF THE DISCLOSURE

The above and other needs are met by aspects of the present disclosure which, in one aspect, provides a capsule object rupture testing system that includes a positioning channel configured to receive one or more smoking article filters therein. The smoking article filters may include a filter element and a capsule object disposed within the filter element. The capsule object rupture testing system may also include a smoking article positioning device configured to position the smoking article filters at a testing position within the positioning channel. The capsule object rupture testing system may also include a rupturing device that includes an actuating element and a measuring element. The actuating element may be configured to operably engage at least one of the smoking article filter elements at the testing position. The testing position may be configured to align the actuating element with an expected position of the capsule object. The measuring element may be configured to determine a deformation measurement associated with deforming the filter element. The capsule object rupture testing system may also include an analysis unit configured to analyze the deformation measurement obtained by the rupturing device. The analysis unit may also be configured to determine a rupture point of the capsule object disposed within the filter element.

According to some embodiments, the capsule object rupture testing system may also include a smoking article repository configured to retain a plurality of smoking article filters therein. According to another embodiment, the smoking article repository may include a dispensing device that is configured to introduce the one of the smoking article filter elements to the positioning channel.

In another embodiment, the measuring device may be configured to measure a response force associated with operably engaging the actuating element with the one of the smoking article filter elements. Additionally or alternatively, the actuating element of the rupturing device may be configured to operably engage the one of the smoking article filter elements disposed in the testing position until the analysis unit detects a force transition corresponding to rupture of the capsule object.

According to some embodiments, the measuring device may be configured to measure a deformation distance associated with operably engaging the actuating element with the one of the smoking article filter elements. Additionally or alternatively, the actuating element of the rupturing device may be configured to operably engage the one of the smoking article filter elements disposed in the testing position until the analysis unit detects a force transition corresponding to rupture of the capsule object.

In some embodiments, the actuating element of the rupturing device may be configured to move along a longitudinal axis of the actuating element. The longitudinal axis of the actuating element may be orthogonal to a longitudinal axis of the positioning channel. In some embodiments, the smoking article positioning device may be configured to displace one of the smoking article filter elements from the testing position by positioning another one of the smoking article filter elements in the testing position. According to some embodiments, the smoking article positioning device may be configured to move a predetermined positioning distance to position the smoking article filter elements in the testing position.

According to another aspect, a method for determining a rupture point of a capsule object disposed within a smoking article filter element is provided. The method may include positioning at least one smoking article filter element that includes a filter material and a capsule object disposed within the filter material to a testing position. The method may include engaging an actuating element of a rupturing device with the smoking article filter element disposed in the testing position. The testing position may be configured to align the actuating element with an expected position of the capsule object within the filter element. The method may include measuring a deformation associated with a deformation of the filter element with a measuring element of the rupturing device. The method may include determining a rupture point of the capsule object disposed within the filter element of the at least one smoking article filter element.

According to some embodiments, the method may further include dispensing at least one smoking article filter element to a positioning channel. In some embodiments, the method that includes positioning at least one smoking article filter element to the testing position further includes moving a smoking article positioning device a predetermined positioning distance. According to some embodiments, moving the smoking article positioning device a predetermined positioning distance may further include moving the smoking article positioning device in a direction parallel to a longitudinal axis of the positioning channel. In another embodiment, positioning the at least one smoking article filter element to the testing position may further include displacing one of the smoking article filter elements from the testing position by positioning another one of the smoking article filter elements in the testing position.

According to another embodiment, the method that includes measuring the deformation associated with the deformation of the filter element with the measuring device of the rupturing device may further include measuring a deformation distance associated with operably engaging the actuating element with one of the smoking article filter elements. Additionally or alternatively, the method may include detecting a deformation transition that corresponds to a rupture of the capsule object with an analysis unit.

In another embodiment, the method that includes measuring the deformation associated with the deformation of the filter element with the measuring element of the rupturing device further comprises measuring a response force associated with operably engaging the actuating element with the one of the smoking article filter elements. Additionally or alternatively, the method may further include detecting a deformation transition corresponding to a rupture of the capsule object with an analysis unit.

According to another embodiment, the method may also include disengaging the actuating element of the rupturing device with the smoking article filter element disposed in the testing position after detecting a deformation transition corresponding to the rupture of the capsule object.

These and other features, aspects, and advantages of the disclosure will be apparent from a reading of the following detailed description together with the accompanying drawings, which are briefly described below.

BRIEF DESCRIPTION OF THE DRAWINGS

In order to assist the understanding of aspects of the disclosure, reference will now be made to the appended drawings, which are not necessarily drawn to scale and in which like reference numerals refer to like elements. The drawings are exemplary only, and should not be construed as limiting the disclosure.

DETAILED DESCRIPTION OF THE ASPECTS OF THE DISCLOSURE

The present disclosure will now be described more fully hereinafter with reference to exemplary aspects thereof. These exemplary aspects are described so that this disclosure will be thorough and complete, and will fully convey the scope of the disclosure to those skilled in the art. Indeed, the disclosure may be expressed in many different forms and should not be construed as limited to the aspects set forth herein; rather, these aspects are provided so that this disclosure will satisfy applicable legal requirements. As used in the specification, and in the appended claims, the singular forms "a", "an", "the", include plural referents unless the context clearly dictates otherwise.

Figure 1:
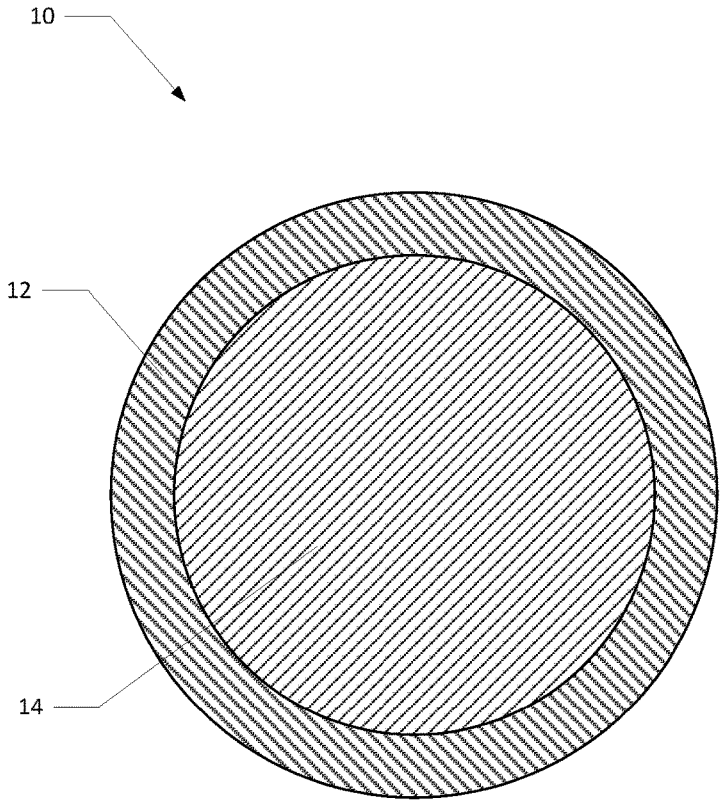
FIG. 1 illustrates a cross-sectional view through a capsule object according to an example aspect of the present disclosure.

As shown in FIG. 1, capsule objects 10 of the type disclosed herein may include an outer shell 12 incorporating an outer shell material, and an inner payload 14 incorporating an aqueous or non-aqueous liquid (e.g., a solution or dispersion of at least one flavoring ingredient within water or an organic liquid such as an alcohol or oil, or a mixture of water and a miscible liquid like alcohol or glycerin).

Representative types of capsules are of the type commercially available as "Momints" by Yosha! Enterprises, Inc. of Westfield, N.J. and "Ice Breakers Liquid Ice" from The Hershey Company of Derry Township, Pa. Representative types of capsules also have been incorporated in chewing gum, such as the type of gum marketed under the tradename "Cinnaburst" by Cadbury Adams USA of Parsippany, N.J. Representative types of capsules and components thereof also are set forth in U.S. Pat. No. 3,339,558 to Waterbury; U.S. Pat. No. 3,390,686 to Irby, Jr. et al.; U.S. Pat. No. 3,685,521 to Dock; U.S. Pat. No. 3,916,914 to Brooks et al.; U.S. Pat. No. 4,889,144 to Tateno et al. and U.S. Pat. No. 6,631,722 to MacAdam et al.; and PCT Application WO 03/009711 to Kim; which are incorporated herein by reference in their entireties. See also, the types of capsules and components thereof set forth in U.S. Pat. No. 5,223,185 to Takei et al.; U.S. Pat. No. 5,387,093 to Takei; U.S. Pat. No. 5,882,680 to Suzuki et al.; U.S. Pat. No. 6,719,933 to Nakamura et al.; U.S. Pat. No. 7,754,239 to Mane et al. and U.S. Pat. No. 6,949,256 to Fonkwe et al.; and U.S. Pat. App. Pub. Nos. 2004/0224020 to Schoenhard; 2005/0196437 to Bednarz et al. and 2005/0249676 to Scott et al.; which are incorporated herein by reference in their entireties.

In some aspects, the capsule object 10 may include an inner payload 14 that includes a flavoring agent configured to flavor the tobacco product. Preferred components of the inner payload 14 provide a desired alteration to the sensory attributes of the tobacco product such as, for example, smell, flavor, and/or mouthfeel. Exemplary flavoring agents that can be encapsulated within the capsule objects 10 can be natural or synthetic, and the character of these flavors can be described, without limitation, as fresh, sweet, herbal, confectionary, floral, fruity or spice. Specific types of flavors include, but are not limited to, vanilla, coffee, chocolate, cream, mint, spearmint, menthol, peppermint, wintergreen, lavender, cardamom, nutmeg, cinnamon, clove, cascarilla, sandalwood, honey, jasmine, ginger, anise, sage, licorice, lemon, orange, apple, peach, lime, cherry, and strawberry. See also, Leffingwill et al., Tobacco Flavoring for Smoking Products, R. J. Reynolds Tobacco Company (1972), which is incorporated herein by reference in its entirety. Flavorings also can include components that are considered moistening, cooling or smoothening agents, such as eucalyptus. These flavors may be provided neat (i.e., alone) or in a composite (e.g., spearmint and menthol, or orange and cinnamon). Composite flavors may be combined in a single capsule object 10 as a mixture, or as components of multiple capsule objects 10. Preferably, the capsule objects 10 do not incorporate any tobacco within their outer shells 12, or within their inner payload 14 regions. However, if desired, other embodiments of capsule objects may incorporate tobacco (e.g., as finely group tobacco pieces and/or tobacco extracts) within their outer shells and/or within their inner payload regions. See, for example, U.S. Pat. No. 7,836,895 to Dube et al., which is incorporated herein by reference in its entirety.

In some aspects, the inner payload 14 is a mixture of a flavoring agent and a diluting agent or carrier. A preferred diluting agent is a triglyceride, such as a medium chain triglyceride, and more particularly a food grade mixture of medium chain triglycerides. See, for example, Radzuan et al., Porim Bulletin, 39, 33-38 (1999), which is incorporated herein by reference in its entirety. The amount of flavoring and diluting agent within the capsule object 10 may vary. In some instances, the diluting agent may be eliminated altogether, and the entire inner payload 14 can be composed of the flavoring agent entirely. Alternatively, the inner payload 14 can be almost entirely comprised of diluting agent, and only contain a very small amount of relatively potent flavoring agent. In one embodiment, the composition of the mixture of flavoring and diluting agent is in the range of about 5 percent to about 75 percent flavoring, and more preferably in the range of about 5 to about 25 percent flavoring, and most preferably in the range of about 10 to about 15 percent, by weight based on the total weight of the inner payload 14, with the balance being diluting agent.

The size and weight of each capsule 10 may vary depending upon the desired properties it is to impart to the tobacco product. Preferred capsules 10 are generally spherical in shape. However, suitable capsules may have other types of shapes, such as generally rectilinear, oblong, elliptical, or oval shapes. Exemplary smaller spherical capsules have diameters of at least about 0.5 mm, generally at least about 1 mm, often at least about 2 mm, and frequently at least about 3 mm. Exemplary larger spherical capsules have diameters of less than about 6 mm, and often less than about 5 mm. Exemplary smaller individual capsules weigh at least about 5 mg, often at least about 10 mg, and frequently at least about 15 mg. Exemplary larger individual capsules weigh less than about 75 mg, generally less than about 65 mg, and often less than about 55 mg. In a preferred embodiment, the capsules define a weight between about 20 grams and about 30 grams and a maximum dimension between about 3 mm and about 4 mm.

The crush strength of the capsule objects 10 is sufficient to allow for normal handling and storage without a significant degree of premature or undesirable breakage. In particular, the crush strength of the outer shell 12 of the capsule objects 10 is sufficient to allow for normal handling and storage without a significant degree of premature and/or undesirable breakage. The crush strength of the capsule objects 10 also is sufficiently low so as to allow the tobacco product user to readily break a capsule object 10 in a purposeful manner when using the particular tobacco product that employs the capsule objects 10. Providing capsule objects 10 that possess both suitable integrity and ability to rupture can be determined by experimentation, depending upon factors such as capsule size and type, and may be a matter of design choice. See, for example, U.S. Pat. No. 7,479,098 to Thomas et al., which is incorporated herein by reference in its entirety.

Capsule objects 10 may be incorporated within tobacco products and/or tobacco-related products such as, for example, filter elements, rods of tobacco, and/or within smokeless tobacco products such as a snuff or snus product. Examples of tobacco products including capsules are described in U.S. Pat. App. Pub. No. 2011/0271968 to Carpenter et al., U.S. Pat. No. 8,695,609 to Dube et al., U.S. Pat. No. 8,308,623 to Nelson et al., and U.S. Pat. No. 7,793,665 to Dube et al., each of which are incorporated herein by reference in their entireties.

Figure 2:
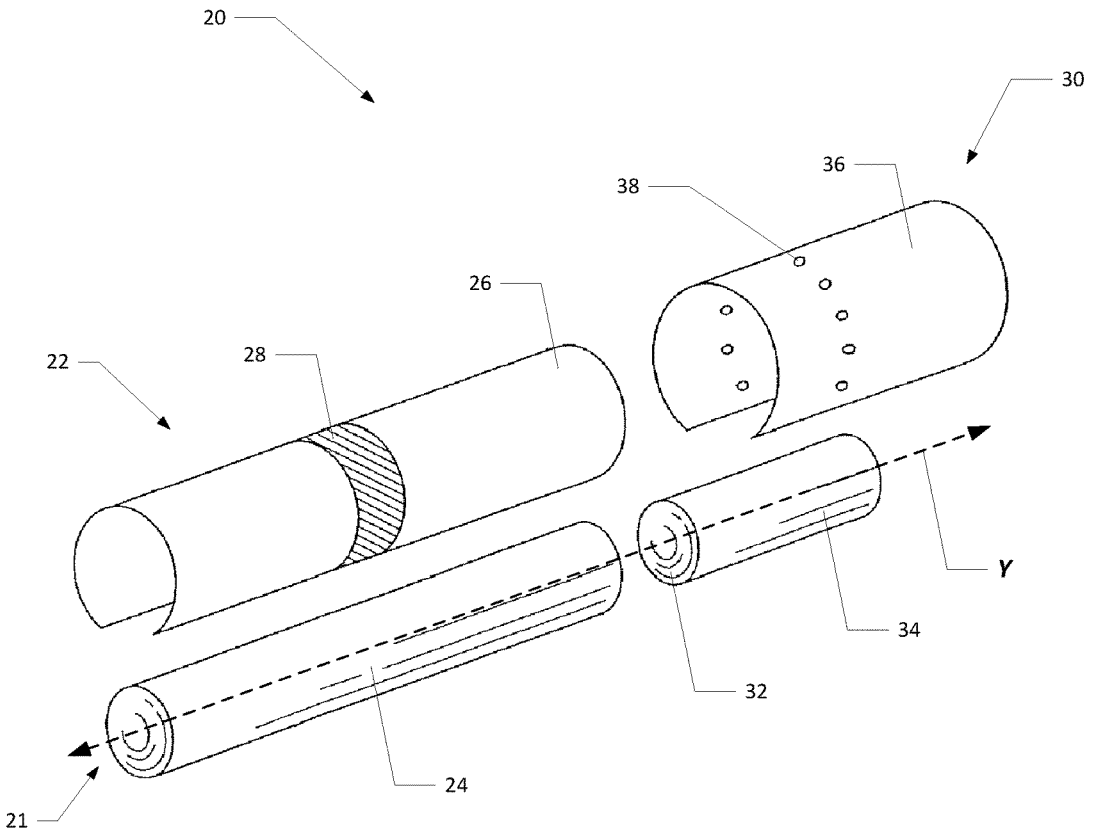
FIG. 2 illustrates an exploded perspective view of a smoking article according to an example aspect of the present disclosure.

In this regard, FIG. 2 illustrates an exploded perspective view of a smoking article 20 (e.g., a filtered cigarette) that may include a capsule object 10 (see, e.g., FIG. 3) therein. In particular, the smoking article 20 may possess certain representative components of a smoking article according to various aspects of the present disclosure. In particular, the smoking article 20 may include a generally cylindrical rod 22 of a charge or roll of smokable filler material 24 (e.g., tobacco material) contained in a circumscribing wrapping material 26. The cylindrical rod 22 is conventionally referred to as a "tobacco rod."

Exemplary smokeable filler material 24 suitable for incorporation into the tobacco rod 22 can vary. For example, tobacco materials can be derived from various types of tobacco, such as flue-cured tobacco, burley tobacco, Oriental tobacco or Maryland tobacco, dark tobacco, dark-fired tobacco and Rustica tobaccos, as well as other rare or specialty tobaccos, or blends thereof. Descriptions of various types of tobaccos, growing practices, harvesting practices and curing practices are set for in Tobacco Production, Chemistry and Technology, Davis et al. (Eds.) (1999), which is incorporated herein by reference in its entirety. Most preferably, the tobaccos are those that have been appropriately cured and aged.

Typically, tobacco materials for cigarette manufacture are used in a so-called "blended" form. For example, certain popular tobacco blends, commonly referred to as "American blends," comprise mixtures of flue-cured tobacco, burley tobacco and Oriental tobacco. Such blends, in many cases, contain tobacco materials that have a processed form, such as processed tobacco stems (e.g., cut-rolled or cut-puffed stems), volume expanded tobacco (e.g., puffed tobacco, such as dry ice expanded tobacco (DIET), preferably in cut filler form). Tobacco materials also can have the form of reconstituted tobaccos (e.g., reconstituted tobaccos manufactured using paper-making type or cast sheet type processes). The precise amount of each type of tobacco within a tobacco blend used for the manufacture of a particular cigarette brand varies from brand to brand. See, for example, Tobacco Encyclopedia, Voges (Ed.) p. 44-45 (1984), Browne, The Design of Cigarettes, 3rd Ed., p. 43 (1990) and Tobacco Production, Chemistry and Technology, Davis et al. (Eds.) p. 346 (1999), which are incorporated herein by reference in their entireties. Other representative tobacco types and types of tobacco blends also are set forth in U.S. Pat. No. 4,836,224 to Lawson et al.; U.S. Pat. No. 4,924,888 to Perfetti et al.; U.S. Pat. No. 5,056,537 to Brown et al.; U.S. Pat. No. 5,220,930 to Gentry; U.S. Pat. No. 5,360,023 to Blakley et al.; U.S. Pat. No. 6,701,936 to Shafer et al.; U.S. Pat. No. 7,025,066 to Lawson et al.; PCT WO 02/37990; and Bombick et al., Fund. Appl. Toxicol., 39, p. 11-17 (1997); all of which are incorporated herein by reference in their entireties.

Tobacco materials incorporated into the tobacco rod 22 typically are used in forms, and in manners, that are traditional for the manufacture of smoking articles 20. The tobacco normally is used in cut filler form (e.g., shreds or strands of tobacco filler cut into widths of about 1/10 inch to about 1/60 inch, preferably about 1/20 inch to about 1/35 inch, and in lengths of about 1/4 inch to about 3 inches). The amount of tobacco material incorporated into the smokable filler material 24 of the tobacco rod 22 of the smoking article 20 may range from about 0.6 g to about 1 g. In some aspects, the amount of smokable filler material 24 normally employed is sufficient to fill the tobacco rod 22 at a packing density of about 100 mg/cm$^3$ to about 300 mg/cm$^3$, and often about 150 mg/cm$^3$ to about 275 mg/cm$^3$.

If desired, the smokable filler material 24 of the tobacco rod 22 may further include other components. Other components include casing materials (e.g., sugars, glycerin, cocoa and licorice) and top dressing materials (e.g., flavoring materials, such as menthol). The selection of particular casing and top dressing components is dependent upon factors such as the sensory characteristics that are desired, and the selection of those components will be readily apparent to those skilled in the art of cigarette design and manufacture. See, for example, Gutcho, Tobacco Flavoring Substances and Methods, Noyes Data Corp. (1972) and Leffingwell et al., Tobacco Flavoring for Smoking Products (1972), which is incorporated herein by reference in its entirety.

As shown in FIG. 2, the ends of the tobacco rod 22 are open to expose the smokable filler material 24. In some aspects, a first end of the tobacco rod 22 is the lighting end 21, and a longitudinally opposed second end may be positioned proximate a smoking article filter element 30. The smoking article 20 is shown having one optional printed band 28 on the circumscribing printed wrapping material 26. The printed band 28 may circumscribe the cylindrical tobacco rod 22 in a direction transverse to a longitudinal axis Y of the smoking article 20. That is, the printed band 28 provides a cross-directional region relative to the longitudinal axis Y of the smoking article 20. The printed band 28 can be printed on the inner surface of the wrapping material 26 (i.e., facing the smokable filler material 24) or on the outer surface of the wrapping material 26. Although the smoking article 20 can possess a wrapping material having one optional band, the cigarette also can possess wrapping material 26 having further optional spaced bands numbering two, three, or more.

The wrapping material 26 of the tobacco rod 22 can have a wide range of compositions and properties. The selection of a particular wrapping material 26 will be readily apparent to those skilled in the art of cigarette design and manufacture. Tobacco rods 22 can have one layer of wrapping material 26; or tobacco rods 22 can have more than one layer of circumscribing wrapping material 26, such as is the case for the so-called "double wrap" tobacco rods. Exemplary types of wrapping materials, wrapping material components and treated wrapping materials are described in U.S. Pat. No. 5,220,930 to Gentry; U.S. Pat. No. 6,997,190 to Stokes et al.; U.S. Pat. No. 7,195,019 to Hancock et al.; and U.S. Pat. No. 7,276,120 to Holmes et al., which are incorporated herein by reference in their entireties.

The smoking article 20 may include a filter element 30 positioned adjacent one end of the tobacco rod 22 such that the filter element and tobacco rod are axially aligned in an end-to-end relationship, preferably abutting one another. Filter element 30 may have a generally cylindrical shape, and the diameter thereof may be essentially equal to the diameter of the tobacco rod 22. The ends of the filter element 30 permit the passage of air and smoke therethrough. The filter element 30 includes filter material 32 (e.g., plasticized cellulose acetate tow) that is over-wrapped along the longitudinally extending surface thereof with circumscribing plug wrap material 34.

In some embodiments, the filter element 30 can be attached to the tobacco rod 22 by tipping material 36, which circumscribes both the entire length of the filter element 30 and an adjacent region of the tobacco rod 22. The inner surface of the tipping material 36 is fixedly secured to the outer surface of the plug wrap 34 and the outer surface of the wrapping material 26 of the tobacco rod 22, using a suitable adhesive; and hence, the filter element 30 and the tobacco rod 22 are connected to one another. A ventilated or air diluted smoking article can be provided with an optional air dilution means, such as a series of perforations 38. According to some aspects, each of the perforations 38 may extend through the tipping material 36 and the plug wrap 34. For example, pre-perforated tipping material 36 and porous plug wrap 34 can be employed, or the filter element 30 can be provided with a circumscribing ring of laser perforations. According to some aspects, the filter element 30 can have two or more filter segments (not shown), and/or additives incorporated therein such as via the capsule object 10 (see, e.g., FIG. 3), as described in greater detail herein.

The tobacco rod 22, the filter element 30, and the smoking article 20 resulting from the combination thereof can be manufactured using various types of conventional cigarette and cigarette component manufacturing techniques and equipment, without extensive modification to certain of those conventional techniques and equipment. See, for example, the types of cigarette making equipment set forth in U.S. Pat. No. 7,275,549 to Hancock et al. and U.S. Pat. No. 7,276,120 to Holmes et al., which are incorporated herein by reference in their entireties. Certain aspects of the manners and methods suitable for the commercial production of cigarettes of the present invention using the tobacco rods, filter elements, and other components described herein will be readily apparent to those skilled in the art of cigarette manufacture.

Figure 3:
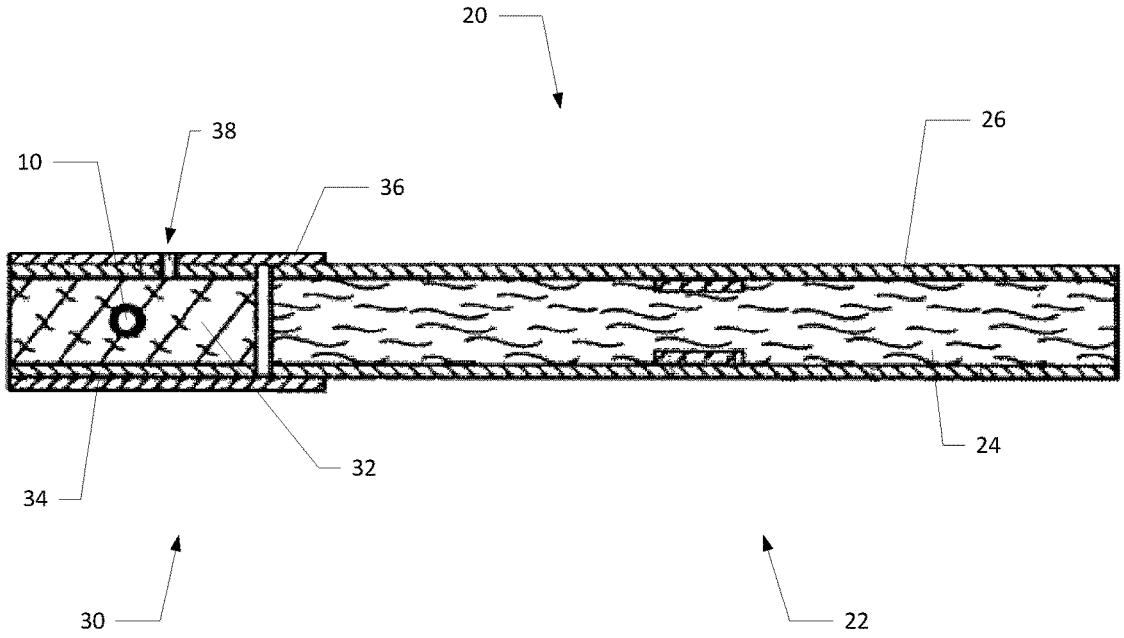
FIG. 3 illustrates a cross-sectional view through a smoking article, such as the smoking article illustrated in FIG. 2, according to an example aspect of the present disclosure.

As illustrated in FIG. 3, the filter element 30 of the smoking article 20 may include the capsule object 10 therein. In this regard, the capsule object 10 may be disposed within the filter material 32. For example, the filter element 30 of the smoking article 20 incorporating the capsule object 10 disposed therein may be manufactured using conventional cigarette and cigarette component manufacturing techniques and equipment as set forth in U.S. Pat. No. 7,479,098 to Thomas et al., which is incorporated by reference herein in its entirety.

Although FIG. 3 illustrates a filter element 30 including a single capsule object 10, the smoking article 20 can possess any number of capsule objects 10 therein, and may further include optional capsule objects 10 numbering two, three, or more. According to some aspects, the filter element 30 may include a plurality of capsule objects 10 positioned along the length of the filter element 30. For example, a filter element 30 may include a plurality of capsule objects 10 arranged serially along the longitudinal axis of the smoking article 20 (i.e., along the longitudinal axis of the filter element 30) in substantially equal intervals. According to another aspect, the filter element 30 may include a plurality of capsule objects 10 dispersed throughout the filter material 32, wherein one capsule object is disposed at a known location with respect to ends of the filter element 30 and the remainder of the capsule objects are disposed at random intervals.

During the manufacture of a tobacco product that includes the capsule object 10, such as the smoking article 20 illustrated in FIGS. 2 and 3, it may be desirable to inspect the tobacco product before packaging and transporting the tobacco product for sale. For example, it may be desirable to inspect and/or test the tobacco product for quality assurance. In some aspects, it may be desirable to inspect and/or test a randomized sample of the tobacco product that includes the capsule object 10 therein for quality assurance. For example, it may be desirable to randomly select a sample of smoking articles 20 that include the capsule object 10 therein so as to determine a rupture point of the capsule object 10 disposed within the filter material 32 of the filter element 30.

Although various embodiments and aspects herein describe a capsule object rupture testing system configured to receive a plurality of smoking articles 20 that include a smoking article filter element 30 having a capsule object 10 disposed therein and configured to determine the rupture point of the capsule object 10 disposed within the filter element 30 of the smoking article 20, additional or alternative aspects of the present disclosure may provide for a capsule object rupture testing system configured to receive, process, and/or manipulate solely a plurality of smoking article filter elements 30, which include a capsule object 10 disposed therein, that have not been joined to a respective tobacco rod 22 and configured to determine the rupture point of the capsule object 10. That is, one of ordinary skill may appreciate the capsule object rupture testing system may be configured to determine a rupture point of a capsule object 10 disposed within a smoking article filter element 30 that has not been attached to a tobacco rod 22 of a smoking article 20 in a previous manufacturing process. Accordingly, some aspects of the present disclosure may advantageously provide for minimizing wasteful disposal of tobacco rods 22 as the smoking article filter elements 30 are not attached to a corresponding tobacco rod 22 so as to form a final tobacco product (i.e., the smoking article 20) when the system determines the rupture point of the capsule object 10. According to some aspects where a capsule object rupture testing system is configured to receive a smoking article 20 that includes a capsule object 10, those aspects may advantageously provide for testing a final tobacco product (i.e., the smoking article 20) that includes the capsule object 10 so as to ensure high-quality, final tobacco products are manufactured and distributed to consumers.

In this regard, FIGS. 4A-4D illustrate a schematic diagram of a capsule object rupture testing system 100 configured to determine a rupture point of a capsule object 10 disposed within a smoking article filter element 30 that has been attached to a corresponding tobacco rod 22 (see, e.g., FIG. 3) to form a smoking article 20 having a capsule object 10. According to some embodiments, the capsule object rupture testing system 100 may include a positioning channel 110 configured to receive at least one smoking article 20 that includes a capsule object 10 disposed therein. In some aspects, the positioning channel 110 may define a testing position disposed between a proximal end 111 and a distal end 112 of the positioning channel 110. Further, the positioning channel 110 may define a longitudinal axis X of the capsule object rupture testing system 100 that extends from the proximal end 111 to the distal end 112 of the positioning channel 110.

Figure 4A:
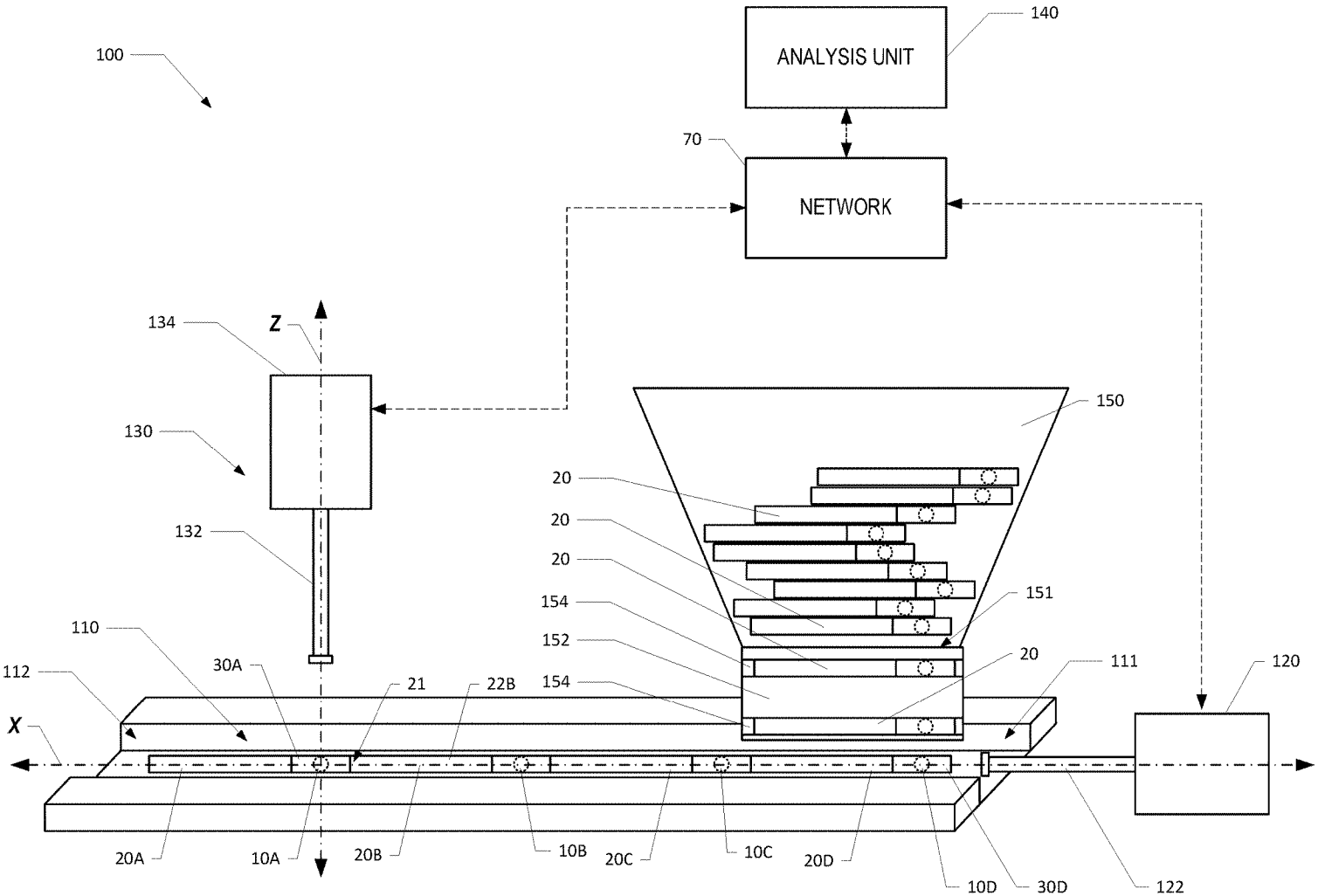
FIG. 4A illustrates a schematic view of a capsule object rupture testing system according to an example aspect of the present disclosure.

As shown in FIGS. 4A-4D, the positioning channel 110 may be configured to receive the plurality of smoking articles 20. In particular, FIG. 4A illustrates a first, second, third and fourth smoking article 20A, 20B, 20C, 20D arranged within the positioning channel 110 from the distal end 112 to the proximal end 111 of the positioning channel respectively. Additionally, the first, second, third, and fourth smoking articles 20A, 20B, 20C, 20D may be disposed within the positioning channel 110 such that the first, second, third, and fourth smoking articles 20A, 20B, 20C, 20D are axially aligned with respect to one another and disposed in an end-to-end relationship, preferably abutting one another. For example, the lighting end 21 of the tobacco rod 22B of a second smoking article 20B may abut the filter element 30A of an adjacent first smoking article 20A disposed in a testing position within the positioning channel 110. Although FIGS. 4A-4D illustrate the positioning channel 110 configured to receive four smoking articles (e.g., first, second, third, and fourth smoking articles 20A, 20B, 20C, 20D), one of ordinary skill in the art will appreciate that the positioning channel 110 may be configured to receive any number of smoking articles or even a single smoking article.

The capsule object rupture testing system 100 includes a rupturing device 130. As shown in FIGS. 4A-4D, the rupturing device 130 may define a vertical axis Z of the capsule object rupture testing system 100 that extends perpendicularly to the longitudinal axis X defined by the positioning channel 110. The rupturing device 130 may include an actuating element 132 configured to move along a direction parallel to the vertical axis Z. In particular, the actuating element 132 may be configured to operably engage the smoking article filter element 30 and/or the capsule object 10 disposed therein by moving along a direction along the vertical axis Z and towards the smoking article filter element 30 of a smoking article 20 disposed in the testing position. In this regard, the testing position may be defined as the position of a smoking article 20 within the positioning channel 110 where an expected position of the capsule object 10 disposed within the smoking article filter element 30 is aligned with the vertical axis Z of the actuating element 132. Accordingly, when the actuating element 132 moves towards the smoking article 20 to operably engage the smoking article filter element 30 and/or the capsule object 10 disposed therein, that actuating element 132 may deform at least a portion of the smoking article filter element 30 and/or the capsule object 10 disposed therein when the actuating element 132 operably engages the smoking article 20.

Figure 4B:
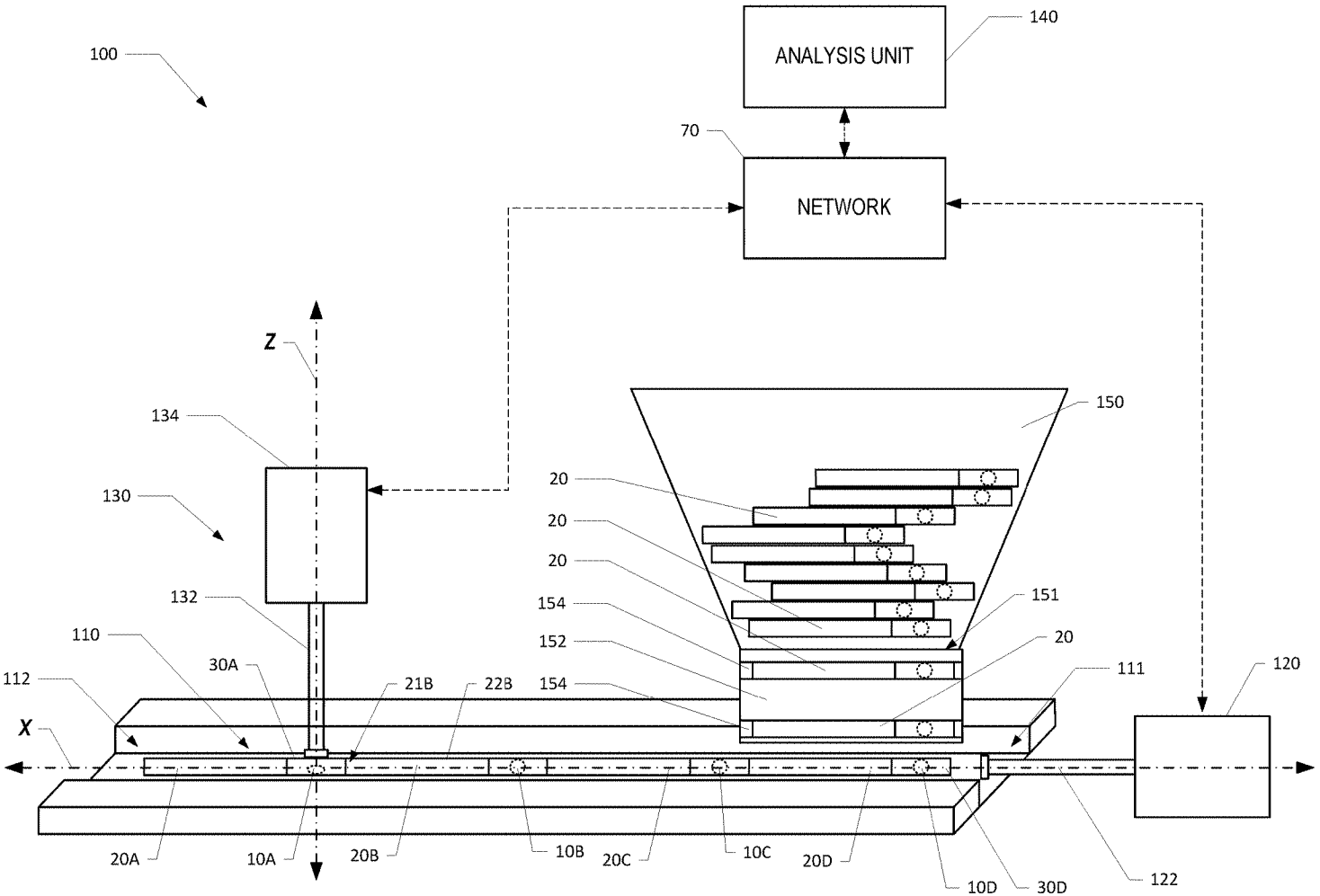
FIG. 4B illustrates a schematic view of the capsule object rupture testing system of FIG. 4A, where an actuating element of a rupturing device is operably engaged with a smoking article filter according to an example aspect of the present disclosure.

For example, as shown in FIGS. 4A and 4B, when the first smoking article 20A is disposed in the testing position and the actuating element 132 moves towards the first smoking article 20A to operably engage the first smoking article filter element 30A and/or the capsule object 10A disposed therein, the expected position of the capsule object 10A is aligned with the vertical axis Z of the actuating element 132. As such, as shown in FIG. 4B, when the actuating element 132 operably engages the first smoking article filter element 30A, at least a portion of the first smoking article filter element and/or the first capsule object 10A disposed therein is deformed such that a rupture point of the capsule object 10A is determined.

Additionally, the rupturing device 130 may further include a measuring element 134 operably engaged with the actuating element 132. For example, the measuring element 134 may be configured determine a deformation measurement associated with the actuating element 132 operably engaging at least one smoking article filter element 30 and/or a capsule object 10 of a smoking article 20 disposed in the testing position. For example, as shown in FIG. 4B, when the actuating element 132 operably engages and/or deforms a portion of the smoking article filter element 30A and/or capsule object 10A disposed in the testing position, the measuring element 134 may be configured to measure the deformation associated with the actuating element 132 deforming the smoking article filter element 30A and/or capsule object 10A disposed therein.

According to some aspects, the measuring element 134 may be configured to measure a response force associated with the actuating element 132 operably engaging the at least one smoking article filter element 30 and/or a capsule object 10 disposed therein of a smoking article 20 disposed in the testing position within the positioning channel 110. For example, the measuring element 134 may be configured to measure a stress force within the actuating element 132 induced by the actuating element 132 operably engaging the smoking article filter element 30 and/or the capsule object 10 disposed therein. In some aspects, the actuating element 132 may include a strain gauge and/or the like that is in communication with the measuring element 134.

Additionally or alternatively, the measuring element 134 may be configured to measure a change and/or transition in the response force associated with the actuating element 132 operably engaging the at least one smoking article filter element 30 and/or capsule object 10 disposed therein of the smoking article 20 disposed in the testing position within the positioning channel 110. According to some aspects, the measuring element 134 may be configured to measure an increasing response force as the actuating element 132 operably engages and continues to extend in a direction towards the at least one smoking article filter element 30 and/or the capsule object 10 disposed therein. Additionally, the measuring element 134 may be configured to measure a sudden change in the magnitude of the response force (e.g., a sudden drop in the magnitude of the response force) associated with the actuating element 132 as the actuating element 132 operably engages the smoking article filter element 30 and/or the capsule object 10 disposed therein. In some aspects, a response force transition (e.g., a sudden drop in the magnitude of the response force) may be attributed to the outer shell 12 of the capsule object 10 disposed within the smoking article filter element 30 rupturing, breaking, and/or otherwise losing structural integrity. According to some aspects, the actuating element 132 may be configured to operably engage the at least one smoking article filter element 30 and/or capsule object 10 of a smoking article 20 disposed in the testing position within the positioning channel 110 until a response force transition is measured by the measuring element 134, as described in greater detail herein.

Additionally or alternatively, the measuring element 134 may be configured to measure a deformation distance, velocity, and/or acceleration of the actuating element 132 associated with the actuating element 132 operably engaging at least one smoking article filter element 30 and/or capsule object 10 disposed therein of a smoking article 20 disposed in the testing position within the positioning channel 110. In particular, the measuring element 134 may be configured to measure a distance the actuating element 132 travels after the actuating element 132 begins to operably engage the smoking article filter element 30 and/or capsule object 10 disposed therein. In some aspects, the measuring element 134 may be configured to measure a velocity of the actuating element 132 after the actuating element 132 begins to operably engage and/or while the actuating element 132 is operably engaging the smoking article filter element 30 and/or capsule object 10 disposed therein. According to some aspects, the measuring element 134 may be configured to measure any accelerations of the actuating element 132 after the actuating element 132 begins to operably engage the smoking article filter element 30 and/or capsule object 10 disposed therein. More particularly, the measuring element 134 may be configured to measure a change in the velocity or acceleration of the actuating element 132 as the actuating element 132 operably engages the smoking article filter element 30. Additionally, the actuating element 132 may be configured to operably engage the at least one smoking article filter element 30 disposed in the testing position until a deformation transition occurs. For example, the actuating element 132 may be configured to operably engage the at least one smoking article filter element 30 disposed in the testing position until a deformation acceleration transition and/or a deformation velocity transition occurs, as described in greater detail herein.

According to some aspects, the capsule object rupturing testing system 100 further includes an analysis unit 140 configured to determine a rupture point of the capsule object 10 disposed within the smoking article filter element 30 when the actuating element 132 operably engages the smoking article filter element 30 and/or capsule object 10. As shown in FIGS. 4A-4D, the analysis unit 140 may be operably engaged with and/or in communication with the rupturing device 130. For example, the analysis unit 140 may be configured to receive and/or analyze electrical signals transmitted by the rupturing device 130 via a network 70. In particular, the analysis unit 140 may be configured to receive and/or analyze data captured by the measuring element 134 of the rupturing device 130 as the actuating element 132 operably engages the smoking article filter element 30 and/or the capsule object 10. Additionally, the analysis unit 140 may be further configured to determine whether the capsule object 10 disposed within the filter material 32 of the at least one smoking article filter element 30 is defective. For example, the analysis unit 140 may be configured to receive electrical signals transmitted by the rupturing device 130 corresponding to the measurements and/or data captured by the measuring element 134. Further, the analysis unit 140 may be configured to compare the captured data with data corresponding to expected values of various properties of the capsule object 10 to determine whether the capsule object 10 is defective.

According to some aspects, the analysis unit 140 may be configured to analyze a deformation measurement obtained by the rupturing device 130 to determine a rupture point of the capsule object 10 disposed within the smoking article filter element 30. For example, the measuring element 134 may be configured to transmit data corresponding to a deformation measurement (e.g., a deformation velocity or acceleration transition as the actuating element 132 operably engages the smoking article filter element 30) to the analysis unit 140 via the network 70. In some embodiments, the measuring element 134 may be configured to transmit data corresponding to a measurement of the change in the response force as the actuating element 132 operably engages the smoking article filter element 30 to the analysis unit 140 via the network 70. Additionally, the analysis unit 140 may be configured to analyze the deformation measurement obtained by the rupturing device 130 so as to determine the rupture point of the capsule object 10 disposed within the smoking article filter element 30 of the smoking article 20. Additionally or alternatively, the analysis unit 140 may be configured to transmit and/or receive electrical signals to and/or from the positioning device 120, as described in greater detail herein.

Figure 4C:
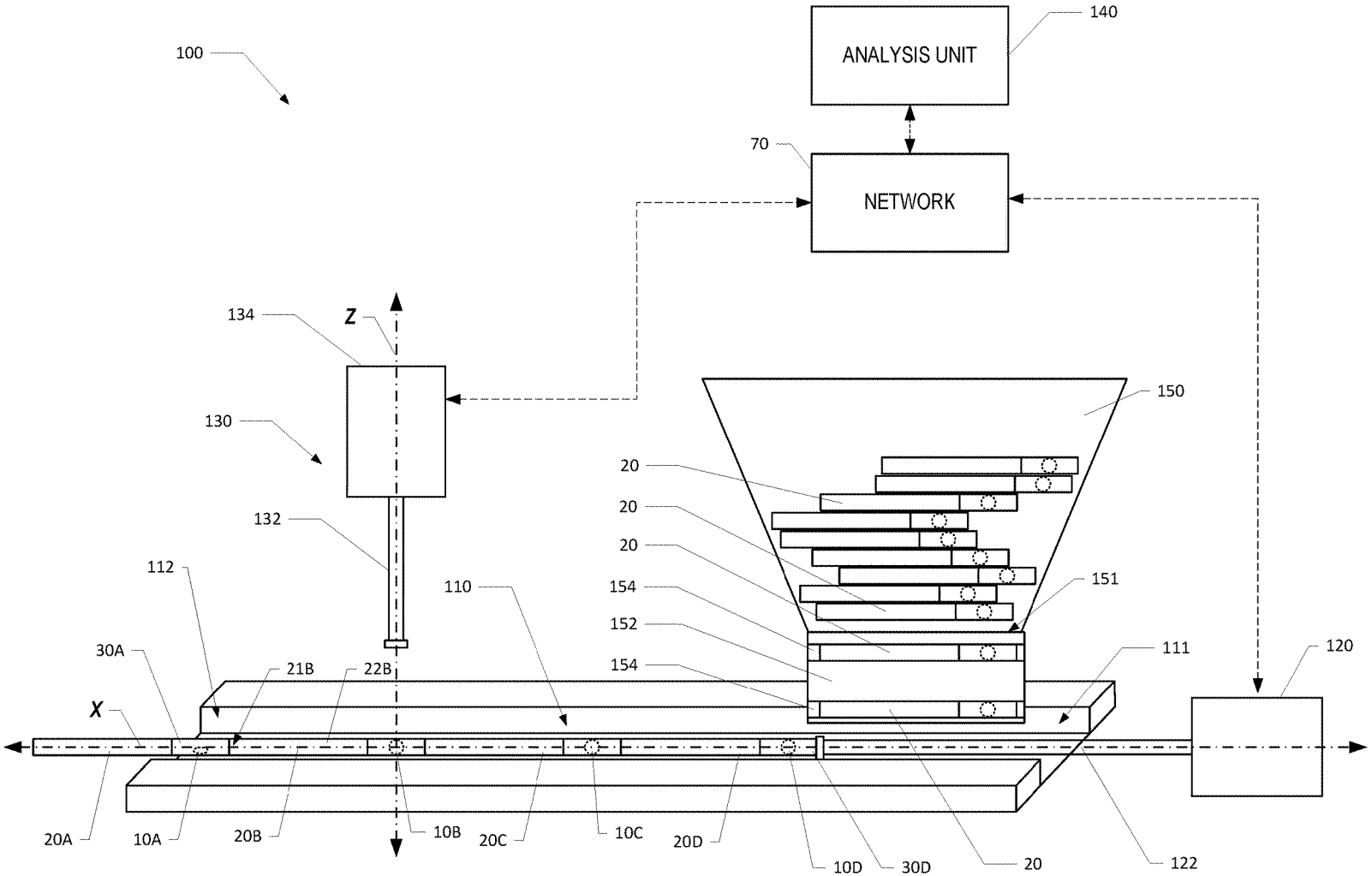
FIG. 4C illustrates a schematic view of the capsule object rupture testing system of FIG. 4A, where a smoking article positioning device is displacing one of the smoking article filters from the testing position by positioning another one of the smoking article filters in the testing position according to one example aspect of the present disclosure.
Figure 4D:
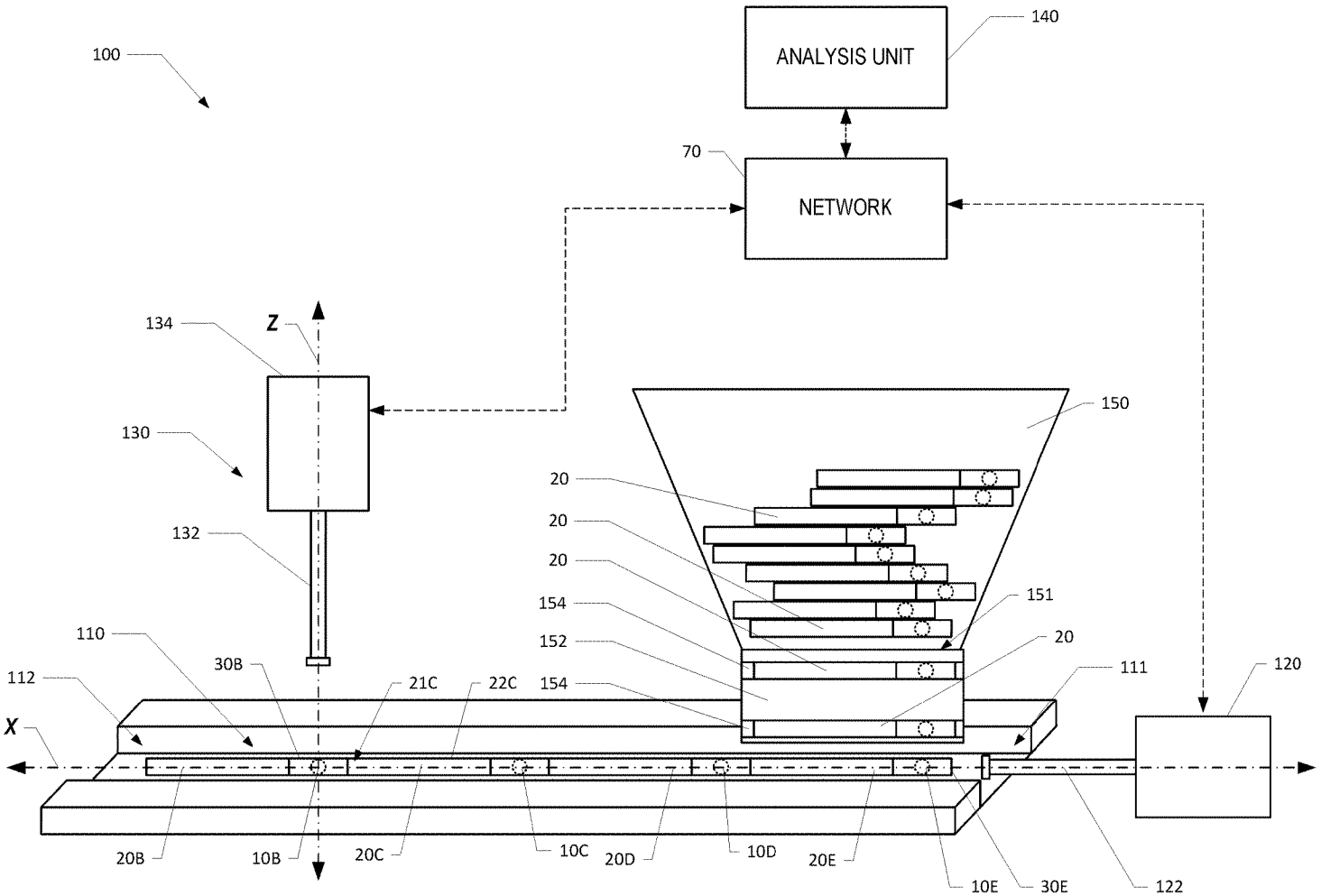
FIG. 4D illustrates a schematic view of the capsule object rupture testing system of FIG. 4A, where a smoking article repository is introducing one of the smoking article filters to the positioning channel according to one example aspect of the present disclosure.

As shown in FIGS. 4A-4D, the capsule object rupture testing system 100 further includes a smoking article positioning device 120 disposed proximate a proximal end 111 of the positioning channel 110. The positioning device 120 may be configured to operably engage at least one smoking article 20 disposed within the positioning channel 110. In particular, as shown in FIGS. 4B and 4C, the positioning device 120 may include a positioning rod 122 that extends along a direction parallel to the longitudinal axis X and configured to operably engage the smoking element 20D disposed proximate to the proximal end 111 of the positioning channel 110. For example, the positioning rod 122 may be configured to extend along longitudinal axis X towards the distal end 112 of the positioning channel 110. In some aspects, as shown in FIGS. 4B and 4C, the positioning rod 122 may be configured to extend a predetermined distance along the positioning channel 110 and towards the distal end 112 of the positioning channel 110 so as to position a particular smoking article 20 at the testing position within the positioning channel 110.

For example, FIGS. 4A and 4B illustrate a positioning rod 122 of a smoking article positioning device 120 disposed in a first position. After the capsule object rupture testing system 100 has determined the rupture point of a capsule object 10A of a first smoking article 20A, the positioning rod 122 may extend along the predetermined distance towards the distal end 112 of the positioning channel 110, as shown in FIG. 4C, thereby operably engaging a smoking article (e.g., the fourth smoking article 20D) disposed proximate the positioning rod 122. In particular, the positioning rod 122 may operably engage the smoking article filter element 30D of the fourth smoking article 20D by extending a predetermined distance along the positioning channel 110 until the positioning rod 122 is disposed in a second position.

According to some aspects, when the positioning rod 122 extends the predetermined distance along the positioning channel 110 towards the second position and operably engages the smoking article 20 disposed proximate the positioning rod 122 (e.g., the fourth smoking article 20D), the first smoking article 20A is displaced from the testing position by the movement of the smoking articles (e.g., the second, third, and fourth smoking articles 20B, 20C, 20D), disposed between the first smoking article 20A and the positioning rod 122, towards the distal end 112 of the positioning channel 110. Accordingly, the first smoking article 20A disposed in the testing position, as shown in FIG. 4A, is displaced by positioning a second smoking article 20B to the testing position via the positioning rod 122 operably engaging the smoking articles (e.g., the fourth smoking article 20D) disposed between the second smoking article 20B and the positioning rod 122.

As shown in FIGS. 4A-4D, the analysis unit 140 may be configured to transmit electrical signals to the positioning device 120 and/or receive electrical signals from the positioning device 120 via the network 70. In some aspects, the analysis unit 140 may be configured to transmit a signal to the positioning device 120 after the analysis unit 140 has analyzed the deformation measurement obtained by the rupturing device 130 and/or determined a rupture point of the capsule object 10 disposed within the smoking article filter element 30. For example, the analysis unit 140 may be configured to transmit a signal to the positioning device 120 that corresponds with instructions for the positioning rod 122 to move from the first position, as shown in FIG. 4B, to the second position, as shown in FIG. 4C. Additionally or alternatively, the analysis unit 140 may be configured to transmit electrical signals to a dispensing device 152 and/or receive electrical signals from the dispensing device 152.

According to some aspects, the capsule object rupture testing system 100 may include a smoking article filter element repository 150 configured to retain, handle and/or store a plurality of smoking articles 20 that include a capsule object 10 therein without any significant degree of premature and/or undesirable breakage of the outer shell 12 of the capsule objects 10. In some aspects, the smoking article filter element repository 150 may define an orifice 151 configured to allow a smoking article 20 to pass therethrough. In one aspect, gravity may urge the smoking articles 20 though the orifice 151 defined by smoking article filter element repository 150. Additionally or alternatively, the smoking article filter element repository 150 may include a rotatable arm within the interior volume of the smoking article filter element repository 150 or other actuator configured to urge the smoking articles 20 that include the capsule object 10 therein through the orifice 151.

In some aspects, the capsule object rupture testing system 100 includes a dispensing device 152 operably engaged with the smoking article filter element repository 150. In particular, the orifice 151 defined by the smoking article filter element repository 150 may be in communication with the dispensing device 152. The dispensing device 152 may be configured to introduce at least one smoking article 20 that includes the capsule object therein to the positioning channel 110.

Figure 5:
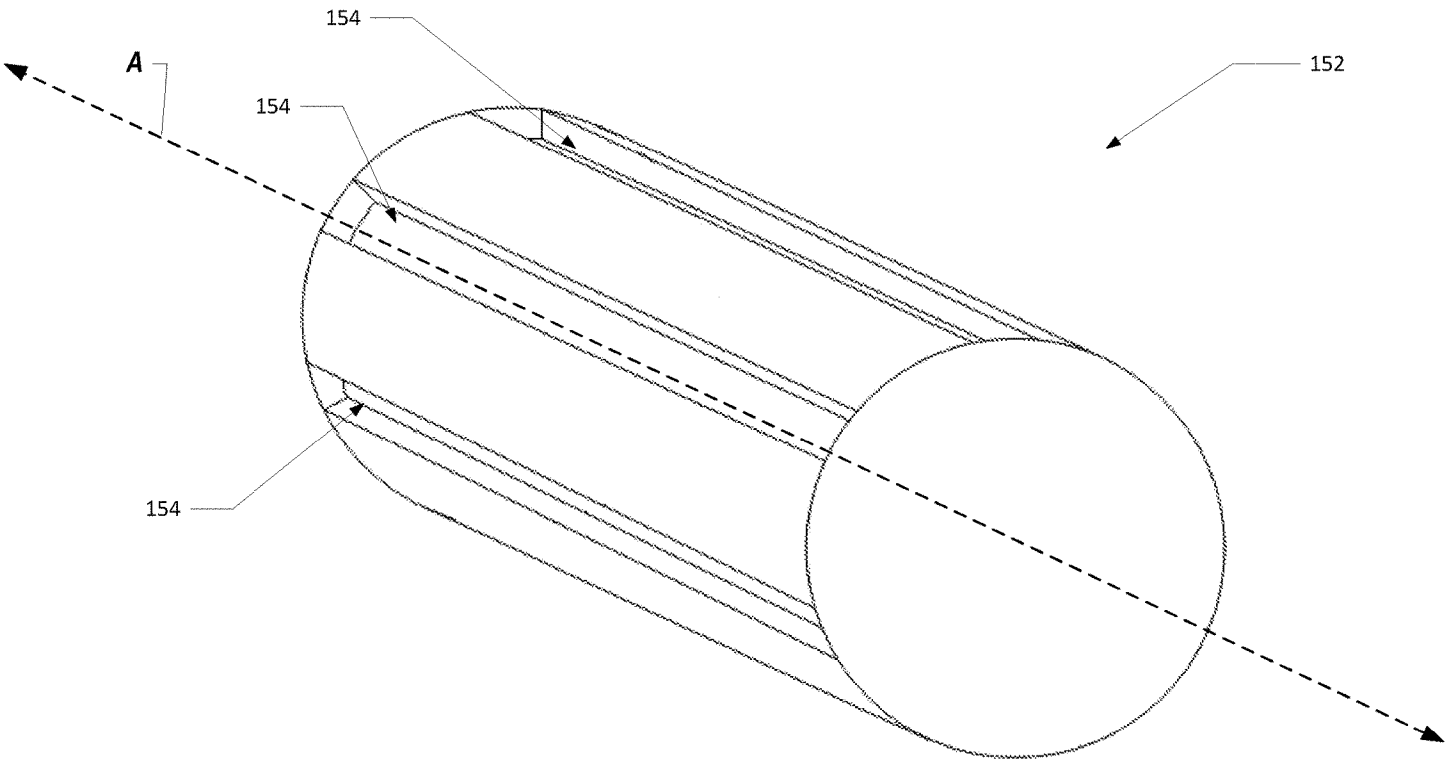
FIG. 5 illustrates a perspective view of a dispensing device of a capsule object rupture testing system according to one example aspect of the present disclosure.
Figure 6:
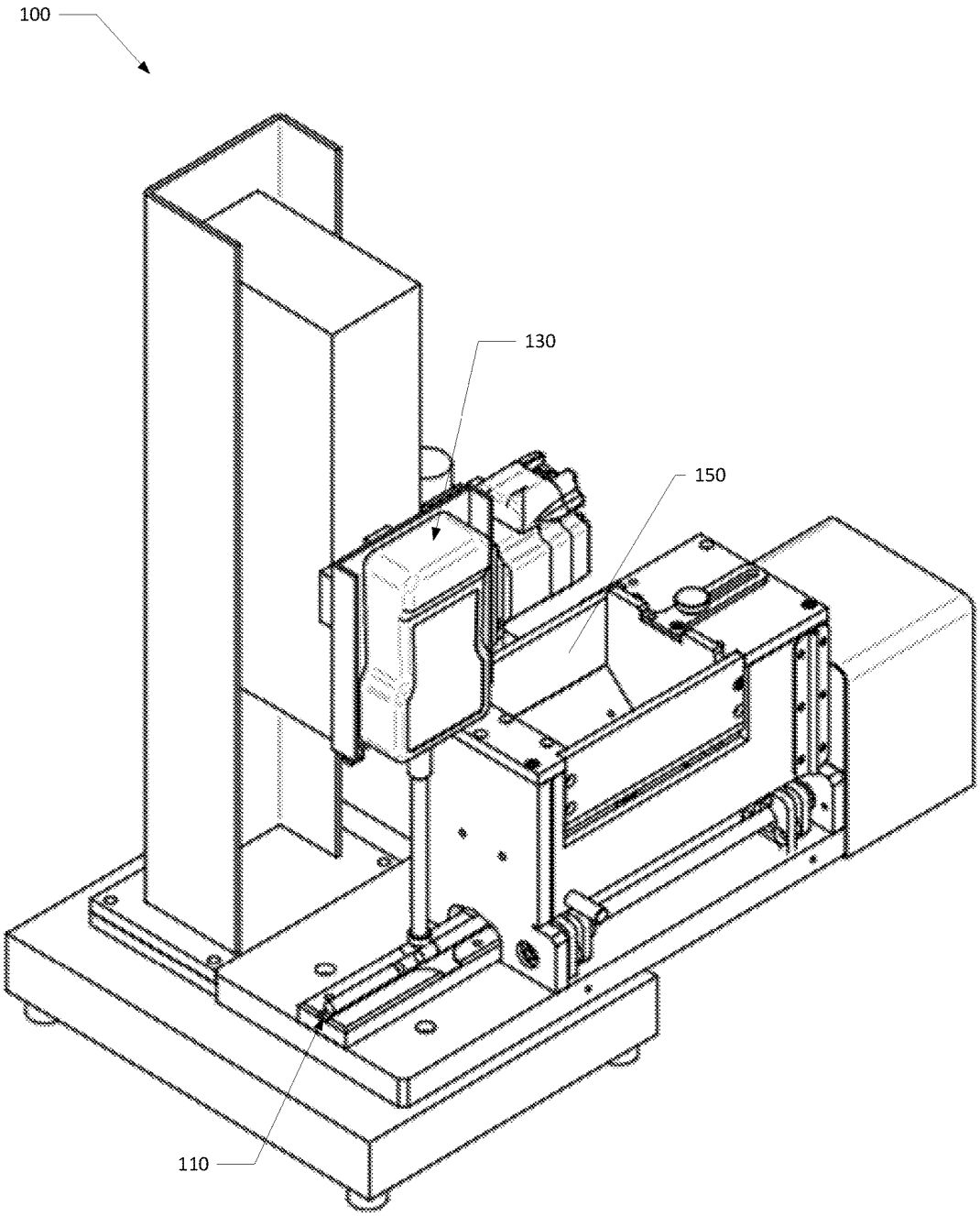
FIG. 6 illustrates a perspective view of the capsule object rupture testing system of FIG. 4A according to one example aspect of the present disclosure.

For example, as shown in FIG. 5, the dispensing device 152 may include a cylinder configured to rotate about a longitudinal axis A and having a generally circumferential peripheral surface. The peripheral circumferential surface may define a plurality of dispensing channels 154. Additionally, the orifice 151 defined by the smoking article filter element repository 150 may be in communication with the peripheral surface of the dispensing device 152 that defines the plurality of dispensing channels 154. Accordingly, when the dispensing device rotates about the longitudinal axis A and a dispensing channel 154 is aligned with the orifice defined by the smoking article filter element repository 150, a smoking article 20 and/or a smoking article filter element 30 may be transported from the repository 150 to the dispensing channel 154. According to some aspects, the plurality of channels 154 defined by the peripheral surface of the dispensing device 152 may be in fluid communication with a vacuum source configured to apply a suction force to each of the plurality of dispensing channels 154. As such, when a dispensing channel 154 aligns with the orifice of the smoking article filter element repository 150, the suction force provided by the vacuum source urges a smoking article 20 and/or a smoking article filter element 30 from the repository 150 and into the dispensing channel 154.

In some aspects, the dispensing device 152 may also be configured to eject the smoking article 20 and/or the smoking article filter element 30 from a particular channel 154 when the channel 154 is positioned to dispense the smoking article 20 and/or smoking article filter element 30 to the positioning channel 110. For example, the dispensing device 152 may be configured such that when a dispensing channel 154 is vertically aligned with the positioning channel 110 (i.e., the dispensing channel 154 and the positioning channel 110 are in communication with each other), the vacuum source operably engaged with the dispensing device 152 ceases providing the suction force to the particular dispensing channel 154 vertically aligned with the positioning channel 110, thereby dispensing the smoking article 20 and/or the smoking article filter element 30 with the capsule object 10 disposed therein to the positioning channel 110. In another aspect, the dispensing device 152 may be configured such that when the dispensing channel 154 is vertically aligned with the positioning channel 110 (i.e., the dispensing channel 154 and the positioning channel 110 are in communication with each other), a fluid source operably engaged with the dispensing device 152 provides a fluid (e.g., compressed air) to the particular dispensing channel 154 vertically aligned with the positioning channel 110. In some aspects, a vacuum source may be continuously provided to each of the dispensing channels 154, regardless of the position of the dispensing channel 154, and a fluid source may be configured to provide a fluid (e.g., compressed air) to the particular dispensing channel 154 vertically aligned with the positioning channel 110, thereby providing a force sufficient to overcome the suction force provided by the vacuum source.

In some aspects, the dispensing device 152 may be configured to dispense and provide the smoking article 20 and/or the smoking article filter element 30 to the positioning channel 110 at predetermined intervals. In this regard, the dispensing device 152 may be configured to rotate about its longitudinal axis A at a constant speed. The plurality of dispensing channels 154 may be arranged at equal angular intervals along the peripheral circumferential surface of the dispensing device 152. Accordingly, the rotational speed of the dispensing device 152 about the longitudinal axis A defines the timing intervals between the smoking articles 20 and/or the smoking article filter elements 30 being introduced to the positioning channel 110. For example, if the rotational speed of the dispensing device 152 increases, the timing intervals between the introductions of the smoking articles 20 and/or the smoking article filter elements 30 decreases. Likewise, if the rotational speed of the dispensing device 152 decreases, the timing intervals between the introductions of each of the smoking articles 20 and/or the smoking article filter elements 30 will increase. When the dispensing device 152 rotates about the longitudinal axis A at a constant speed, the timing intervals between each of the smoking articles 20 and/or smoking article filter elements 30 being introduced to the positioning channel 110 will be equal.

In this regard, the analysis unit 140 may be configured to transmit electrical signals to the dispensing device 152 and/or receive electrical signals from the dispensing device 152 via the network 70 that correspond with instructions for rotating the dispensing device 152 at a particular rotational speed. In some aspects, the analysis unit 140 may be configured to transmit an electrical signal to the dispensing device 152 to rotate about the longitudinal axis A after the analysis unit 140 has determined the rupture point of the capsule 10 disposed in the testing position, as shown in FIG. 4B and/or after the analysis unit 140 has transmitted an electrical signal to the positioning device 120 to extend along towards the distal end 111 of the positioning channel 110, thereby operably engaging and displacing the smoking article disposed proximate the positioning element 122.

Figure 7:
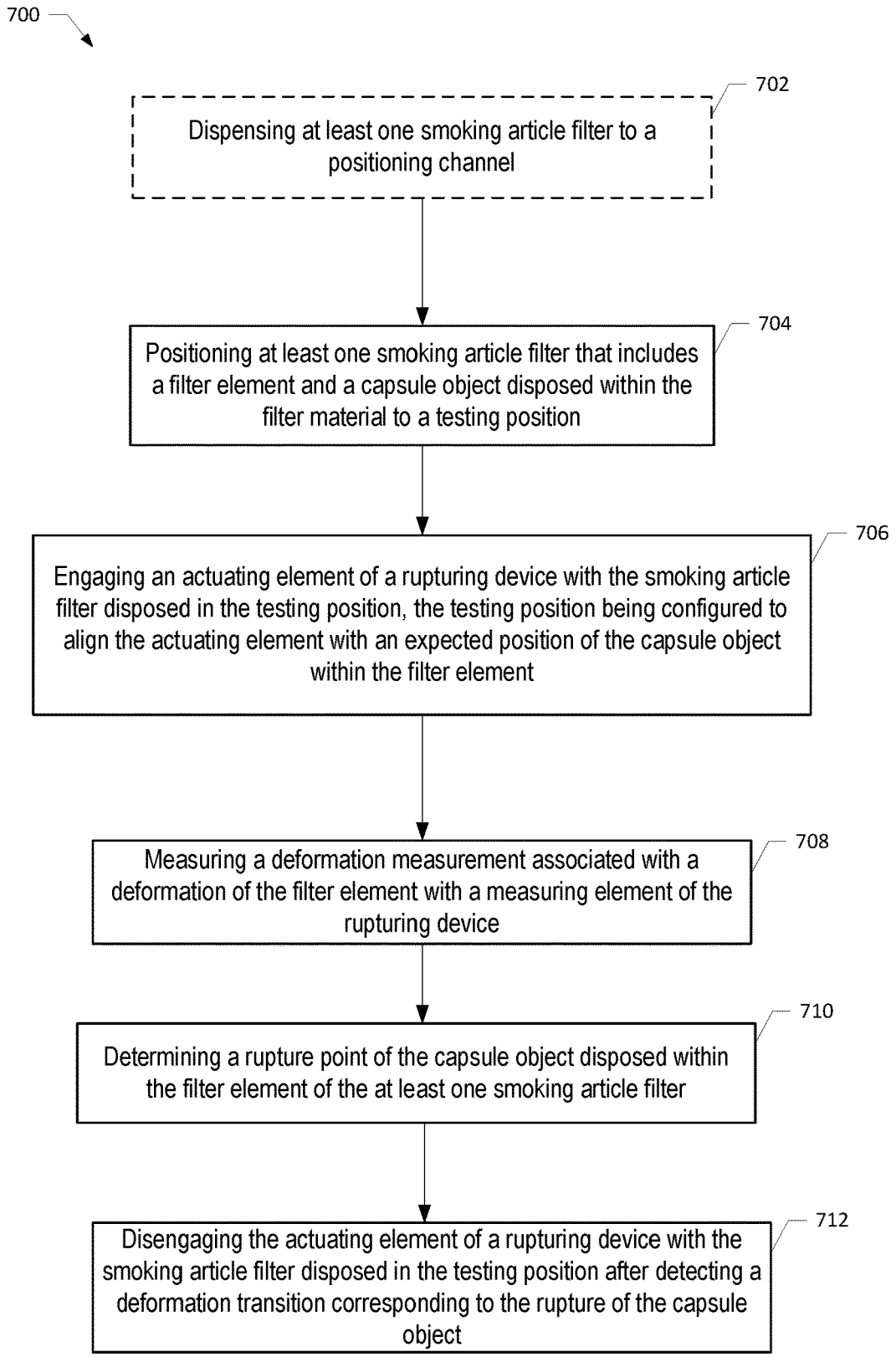
FIG. 7 illustrates a schematic block diagram of a method for determining a rupture point of a capsule object disposed within a smoking article filter element according to one example aspect of the present disclosure.

Various aspects of the present disclosure may also provide a method of determining a rupture point of a capsule object disposed within a smoking article filter element. For example, FIG. 7 illustrates such a method 700 for determining a rupture point of a capsule object 10, which includes an outer shell 12 and an inner payload 14, disposed within a smoking article filter element 30.

According to one aspect, the method 700 for determining a rupture point of a capsule object may include dispensing at least one smoking article filter element to a positioning channel (Block 702). For example, a rotatable arm within the smoking article filter element repository 150 may urge the smoking articles 20 through an orifice of the repository 150 that is in communication with and/or operably engaged with a dispensing channel 154 of the dispensing device 152. The dispensing device 152 may rotate about its longitudinal axis A until the smoking article 20 disposed in the dispensing channel 154 is aligned with and dispensed to the positioning channel 110.

In some aspects, the method 700 may further include positioning at least one smoking article filter element and a capsule object disposed within the filter material to a testing position (Block 704). For example, a positioning rod 122 of a positioning device 120 may extend along and towards the distal end 112 of the positioning channel 110 thereby operably engaging at least one smoking article 20 and/or smoking article filter element 30 with a capsule object 10 disposed therein. In particular, the positioning rod 122 may extend a predetermined distance along and towards the distal end 112 of the positioning channel 110 to urge the smoking article 20 and/or smoking article filter element 30 with the capsule object 10 disposed therein in the same direction. Additionally, the method 700 may include the positioning rod 122 extending along a direction parallel to the longitudinal axis X of the positioning channel 110. In some aspects, the positioning rod 122 may be operably engaged with a second smoking article 20B via the smoking articles 20C, 20D disposed therebetween, as particular shown in FIG. 4C. As such, the positioning device 120 may urge the second smoking article filter element 30B and/or the capsule object 10B disposed therein to the testing position by operably engaging a smoking article 20D disposed proximate to the positioning rod 122.

According to some aspects, the method 700 may include engaging an actuating element of a rupturing device with the smoking article filter disposed in the testing position (Block 706). The testing position may be configured to align the actuating element with an expected position of the capsule object within the smoking article filter element. When the positioning rod 122 extends along and towards the distal end 112 of the positioning channel 110 to operably engage with the smoking article 20D disposed proximate the positioning rod 122, the positioning rod 122 directs at least one smoking article (e.g., the second smoking article 20B) to the testing position by extending a predetermined distance. By extending the predetermined distance, the positioning rod 122 urges the particular smoking article (e.g., the second smoking article 20B) to a testing position where the expected location of the capsule object 10B disposed within the smoking article filter element 30B is aligned with the actuating element 132 of the rupturing device 130.

The method 700 may further include measuring a deformation measurement associated with a deformation of the smoking article filter element with a measuring element of the rupturing device (Block 708). For example, a measuring element 134 of a rupturing device 130 may be configured to measure a deformation measurement associated with an actuating element 132 being operably engaged with a smoking article filter element 30 and/or a capsule object 10 disposed therein. In particular, the measuring element 134 may obtain a deformation measurement such as a response force and/or a change in the response force associated with the actuating element 132 being operably engaged with the smoking article filter element 30 and/or the capsule object 10 disposed therein. In some aspects, the measuring element 134 may obtain a deformation measurement such as a deformation distance, velocity, and/or acceleration of the actuating element 132 associated with the actuating element 132 being operably engaged with the smoking article filter element 30 and/or capsule object 10 disposed therein.

According to some aspects, the method 700 may further include determining a rupture point of the capsule object disposed within the filter element of the at least one smoking article filter element disposed in the testing position (Block 710). For example, the measuring element 134 of the rupturing device 130 may be configured to transmit electrical signal(s) corresponding to deformation measurement(s) to an analysis unit 70. In particular, the measuring element 134 may transmit a plurality of response force measurements obtained over an interval of time as the actuating element 132 extends towards the smoking article filter element 30 and/or becomes operably engaged with the smoking article filter element 30 and/or the capsule object 10 disposed therein. As such, the analysis unit 70 may identify a transition in the response force that corresponds to the rupture point of the capsule object. For example, the response force associated with the actuating element 132 being operably engaged with the smoking article filter element 30 and/or the capsule object 10 disposed therein may increase as the capsule object 10 resists rupturing. Once the force of the actuating element 132 being operably engaged with the smoking article filter element 30 and/or the capsule object 10 disposed therein exceeds a threshold and the capsule object 10 ruptures, the response force associated with the actuating element 132 being operably engaged with the capsule object 10 will decrease thereby indicating the capsule object 10 has ruptured.

According to yet another aspect, the method 700 may further include disengaging the actuating element of the rupturing device from the smoking article filter element disposed in the testing position after detecting a deformation transition corresponding to the rupture of the capsule object (Block 712). For example, the actuating element 132 may revert back to a first position before the actuating element 132 became operably engaged with the next smoking article filter element 30 and/or capsule object 10 disposed within the smoking article 20 disposed in the testing position.

Figure 8:
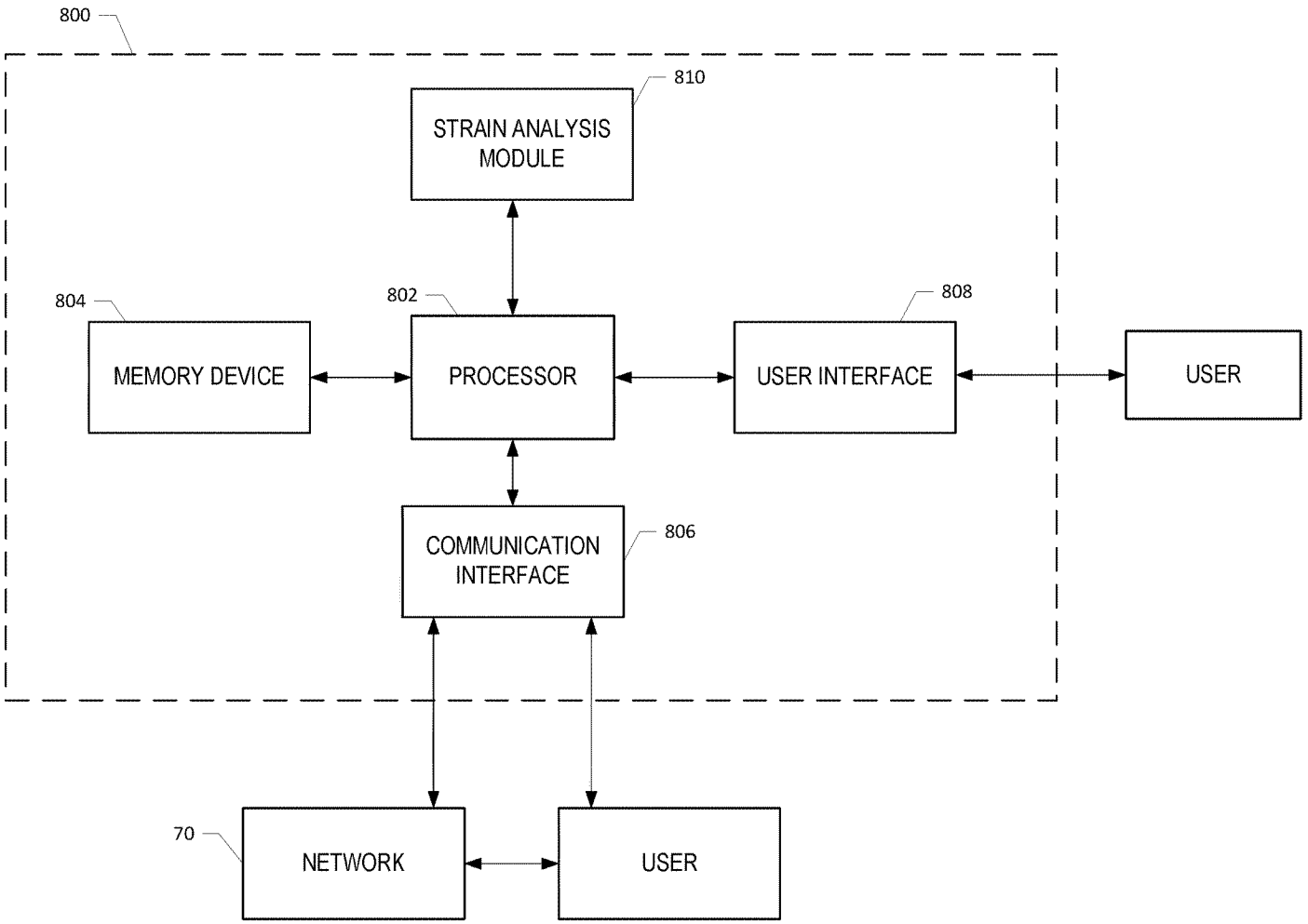
FIG. 8 illustrates a schematic view of components of an analysis unit of a capsule object rupture testing system according to one example aspect of the present disclosure.

Referring to FIG. 8, an apparatus 800 is provided that may be employed by devices performing functions in accordance with example aspects of the present disclosure. The apparatus 800 may be embodied, for example, as any device hosting, including, controlling, comprising, or otherwise forming a portion of the rupturing device 130, the positioning device 120, and/or the analysis unit 140. According to one aspect, the apparatus 800 may be embodied in or as the analysis unit 140. However, aspects of the apparatus 800 may also be embodied on a plurality of other devices such as, for example, where instances of the apparatus may be embodied on the network 70. As such, one aspect of the apparatus 800 illustrated in FIG. 8 is merely an example and may include more, or in some cases, less than the components shown in FIG. 8.

With further regard to FIG. 8, the apparatus 800 may be configured to analyze the deformation measurement obtained by the measuring element 134 of the rupturing device 130 and/or other data captured by the capsule object rupture testing system 100. As depicted in FIG. 8, the apparatus 800 may include or otherwise be in communication with a processor 802, a memory device 804, a communication interface 806, a user interface 808, and/or a strain analysis module 810. The memory device 804 may include non-transitory and tangible memory that may be, for example, volatile and/or non-volatile memory. The memory device 804 may be configured to store information, data, files, applications, instructions or the like. For example, the memory device 804 could be configured to buffer input data for processing by the processor 802. Additionally or alternatively, the memory device 804 could be configured to store instructions for execution by the processor 802.

The apparatus 800 may, in some aspects, be a user terminal, a fixed communication device, and/or a computing device, such as a server configured to employ an example aspect of the present disclosure. However, according to some aspects, the apparatus 800 may be physically embodied as a chip or a chip set. The chip or chipset may constitute means for performing one or more operations for providing the functionalities described herein.

The processor 802 may be embodied in a number of different ways. For example, the processor 802 may be embodied as one or more of various processing means such as a coprocessor, a microprocessor, a controller, a digital signal processor (DSP), processing circuitry, or various other processing devices including integrated circuits such as, for example, a special-purpose computer chip, or other hardware processor. In an example aspect, the processor 802 may be configured to execute instructions stored in the memory device 804 or otherwise accessible to the processor 802. Additionally or alternatively, the processor 802 may be configured to execute hard coded functionality. As such, the processor 802 may be capable of performing operations according to aspects of the present disclosure while configured accordingly. Alternatively, when the processor 802 is embodied as an executor of software instructions, the instructions may specifically configure and/or cause the processor 802 to perform the operations described herein. The processor 802 may include a clock, an arithmetic logic unit (ALU), and/or logic gates that are configured to support operation of the processor 802, amongst other components.

The communication interface 806 may be any means such as a device or circuitry embodied in either hardware, software, or a combination thereof that is configured to receive and/or transmit data. In this regard, the communication interface 806 may include, for example, an antenna and supporting hardware and/or hardwired components and/or software. Accordingly, the communication interface 806 may provide for communication with external devices, such as the network 70, the rupturing device 130, the actuating element 132, the measuring element 134, and/or the positioning device 120. In some aspects, the communication interface 806 may provide for communication with additional portions of the system 100, such as the dispensing device 152. In some aspects, a communication interface 806 may provide for transmitting and/or receiving data through, for example, a wired or wireless network 70, such as a local area network (LAN), a metropolitan area network (MAN), and/or a wide area network (WAN), for example, the Internet.

In some aspects, the apparatus 800 further includes a user interface 808. The user interface 808 may be in communication with the processor 802. For example, the user interface 808 may receive an indication of a user input at the user interface 808 and/or provide an audible/visible, mechanical (e.g., haptic), and/or other output to the user. As such, the user interface 808 may include, for example, a keyboard, a mouse, a joystick, a monitor or display, a touch screen, a microphone, a speaker, and/or any other suitable input/output mechanisms for performing the operations described herein. The processor 802 may be configured to control at least some functions of one or more elements of the user interface 808.

According to some aspects, the apparatus 800 may further include a strain analysis module 810. The processor 802 may be configured to control at least some functions of one or more elements of the strain analysis module 810. The strain analysis module 810 may be configured to execute a strain analysis tool configured to determine a rupture point of a capsule object 10 disposed within a smoking article filter element 30. For example, the strain analysis module 810 may be configured to execute a strain analysis tool configured to determine a rupture point of a capsule object 10 based on data such as, for example, a response force associated with an actuating element 132 operably engaging one of the smoking article filter elements 30 disposed in the testing position.

The various features of the described aspects of the present disclosure can be used separately or in any combination. Various aspects described herein can be implemented by software, hardware or a combination of hardware and software. The described aspects can also be implemented as computer-readable program code portions on a computer readable storage medium for controlling and/or performing the above-described operations. In this regard, a computer readable storage medium, as used herein, refers to a non-transitory, physical storage medium (e.g., a volatile or non-volatile memory device), which can be read by a computer system. Examples of computer readable storage medium include read-only memory, random-access memory, CD-ROMs, DVDs, magnetic tape, optical data storage devices and/or the like. The computer readable storage medium can also be distributed over network-coupled computer systems so that the computer-readable program code portions are stored and executed in a distributed fashion.

Many modifications and other aspects of the disclosure set forth herein will come to mind to one skilled in the art to which the disclosure pertains having the benefit of the teachings presented in the foregoing description and the associated drawings. Therefore, it is to be understood that the disclosure is not to be limited to the specific aspects disclosed and that modifications and other aspects are intended to be included within the scope of the appended claims. Moreover, although the foregoing description and the associated drawings describe example aspects in the context of certain example combinations of elements and/or functions, it should be appreciated that different combinations of elements and/or functions may be provided by alternative aspects without departing from the scope of the appended claims. In this regard, for example, different combinations of elements and/or functions than those explicitly described above are also contemplated as may be set forth in some of the appended claims. Although specific terms are employed herein, they are used in a generic and descriptive sense only and not for purposes of limitation.

What is claimed is:

1. A capsule object rupture testing system comprising:

a positioning channel defining a longitudinally-extending axis configured to receive one or more smoking article filter elements therein, the smoking article filters respectively comprising a filter material and a capsule object disposed within the filter material;

a smoking article positioning device configured to position the smoking article filter elements at a testing position within the positioning channel, the testing position being aligned with the longitudinally-extending axis of the positioning channel;

a rupturing device comprising:

an actuating element configured to operably engage at least one smoking article filter element at the testing position, such that, the actuating element is aligned with an expected position of the capsule object, and a measuring element configured to determine a deformation measurement associated with deforming the smoking article filter element, wherein the deformation measurement comprises a response force and a change in the response force associated with operably engaging the actuating element with the one of the smoking article filter elements; and an analysis unit configured to:

determine whether the capsule object disposed within the filter material of the smoking article filter element is in the expected position from a comparison of the deformation measurement with an expected deformation measurement, the expected deformation measurement being associated with the capsule object being in the expected position, such that if the capsule object is not in the expected position within the smoking article filter element then the deformation measurement and the expected deformation measurement will be different and the smoking article filter element is defective; and if the capsule object disposed within the smoking article filter element is in the expected position, determine a rupture point of the capsule object.

2. The capsule object rupture testing system of claim 1 further comprising a smoking article filter element repository configured to retain a plurality of smoking article filter elements therein.

3. The capsule object rupture testing system of claim 2, further comprising a dispensing device, the dispensing device operably engaged with the smoking article filter element repository and configured to introduce the smoking article filter elements to the positioning channel.

4. The capsule object rupture testing system of claim 1, wherein the actuating element of the rupturing device is configured to operably engage the one of the smoking article filter elements disposed in the testing position until the analysis unit detects the change in the response force, which comprises a force transition corresponding to rupture of the capsule object.

5. The capsule object rupture testing system of claim 1, wherein the measuring element is configured to measure a deformation distance associated with operably engaging the actuating element with the one of the smoking article filter elements.

6. The capsule object rupture testing system of claim 5, wherein the actuating element of the rupturing device is configured to operably engage the one of the smoking article filter elements disposed in the testing position until the analysis unit detects a deformation transition corresponding to rupture of the capsule object.

7. The capsule object rupture testing system of claim 1, wherein the actuating element of the rupturing device is configured to move along a longitudinal axis of the actuating element, the longitudinal axis of the actuating element being orthogonal to the longitudinally-extending axis of the positioning channel.

8. The capsule object rupture testing system of claim 7, wherein the smoking article positioning device is configured to displace one of the smoking article filter elements from the testing position by positioning another one of the smoking article filter elements in the testing position.

9. The capsule object rupture testing system of claim 1, wherein the smoking article positioning device is configured to move a predetermined positioning distance to position the smoking article filter elements in the testing position.

10. A method for determining a rupture point of a capsule object disposed within a smoking article filter element, the method comprising:

positioning at least one smoking article filter element that includes a filter material and a capsule object disposed within the filter material to a testing position within a positioning channel using a smoking article positioning device, the positioning channel defining a longitudinally-extending axis configured to receive one or more of the smoking article filter elements therein, and the testing position being aligned with the longitudinally-extending axis of the positioning channel;

operably engaging an actuating element of a rupturing device with the smoking article filter element disposed in the testing position, such that the actuating element is aligned with an expected position of the capsule object within the smoking article filter element;

measuring a deformation measurement associated with a deformation of the smoking article filter element with a measuring element of the rupturing device, wherein the deformation measurement comprises a response force and a change in the response force associated with operably engaging the actuating element with the one of the smoking article filter elements;

determining whether the capsule object disposed within the filter material of the smoking article filter element is in the expected position from a comparison of the deformation measurement with an expected deformation measurement, the expected deformation measurement being associated with the capsule object being in the expected position, such that if the capsule object is not in the expected position within the smoking article filter element then the deformation measurement and the expected deformation measurement will be different and the smoking article filter element is defective; and if the capsule object disposed within the smoking article filter element is in the expected position, determining a rupture point of the capsule object.

11. The method of claim 10 further comprising dispensing at least one smoking article filter element to the positioning channel.

12. The method of claim 10, wherein positioning at least one smoking article filter element to the testing position further comprises moving the smoking article positioning device a predetermined positioning distance.

13. The method of claim 12, wherein moving the smoking article positioning device the predetermined positioning distance further comprises moving the smoking article positioning device in a direction parallel to the longitudinally-extending axis of the positioning channel.

14. The method of claim 13, wherein positioning at least one smoking article filter element to the testing position further comprises displacing one of the smoking article filter elements from the testing position by positioning another one of the smoking article filter elements in the testing position.

15. The method of claim 10, wherein measuring the deformation measurement further comprises measuring a deformation distance associated with operably engaging the actuating element with the one of the smoking article filter elements.

16. The method of claim 15 further comprising detecting a deformation transition corresponding to a rupture of the capsule object with an analysis unit.

17. The method of claim 10, further comprising detecting the change in the response force, which comprises a force transition corresponding to a rupture of the capsule object with an analysis unit.

18. The method of claim 10 further comprising disengaging the actuating element of the rupturing device with the smoking article filter element disposed in the testing position after detecting a deformation transition corresponding to the rupture of the capsule object.

* * * * *